US007686631B1

(12) United States Patent
Eow et al.

(10) Patent No.: US 7,686,631 B1
(45) Date of Patent: Mar. 30, 2010

(54) ELECTRICAL CONNECTOR WITH A LATCH MECHANISM

(75) Inventors: Yeong Taur Eow, Singapore (SG); Siu Wee Hon, Singapore (SG); Ping Chen, West Bloomfield Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 12/333,689

(22) Filed: Dec. 12, 2008

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 7,090,518 B1 8/2006 Osada et al.
2005/0245114 A1* 11/2005 Shiga ..... 439/157

FOREIGN PATENT DOCUMENTS

WO 2006/112940 A1 10/2006
WO 2006/124127 A1 11/2006

* cited by examiner

*Primary Examiner*—Tho D Ta
(74) *Attorney, Agent, or Firm*—Rader, Fishman & Grauer, PLLC

(57) ABSTRACT

An electrical connector includes a generally box-shaped connector housing and a lever. The lever is pivotally connected to the connector housing and is operative to move from a first fixed position to a second fixed position. In the first fixed position, the lever is releasably connected to the connector housing to prevent the lever from moving towards the second fixed position. In the second fixed position, the lever is releasably connected to the connector housing to prevent the lever from moving towards the first fixed position. Upon releasing the lever from the first fixed position, the lever is operative to pivotally move from the first fixed position to the second fixed position. The electrical connector is adapted for matable connection with a workpiece connector.

12 Claims, 11 Drawing Sheets

ELECTRICAL CONNECTOR WITH A LATCH MECHANISM

FIELD OF THE INVENTION

The present invention relates to an electrical connector. More particularly, the present invention is directed to an electrical connector with a latch mechanism.

BACKGROUND OF THE INVENTION

Electrical connectors having a latch mechanism are known in the art. For instance, U.S. Pat. No. 7,090,518 teaches one such electrical connector. This electrical connector includes a housing and a lever supported pivotally on a pivot disposed on the housing. The lever is configured to rotate on the pivot within a range from a pre-engagement position to a final engagement position. The lever includes a recess configured to accommodate a boss disposed on a mating connector therein in accordance with rotational movement of the lever. The lever also includes a locking mechanism having a detent to engage with an engaging portion disposed on the housing at the final engagement position. Further, the housing includes a latch mechanism disposed on a surface thereof. The latch mechanism engages with an edge portion of the lever at the pre-engagement position. When combined with the mating connector, the latch mechanism primarily interferes with the boss and is displaced so as to release the engagement with the edge portion of the lever. Thus, the engagement with the edge portion is released and thereby the lever freely rotates on the pivot while the boss is being fitted into the recess.

This type of conventional electrical connector is particularly useful for non-waterproof electrical connections. The latch mechanism which is disposed on the housing surface cannot be incorporated on a waterproof connector because the mating connector is covered by the housing. Also, the lever is not seated between the housing and the mating connector for waterproof purposes. Further, the pre-lock latch which is designed on the female housing is not useful on waterproof connectors because it cannot be released by the male housing which is covered by the female housing.

It would be beneficial to provide an electrical connector with a locking mechanism that can be employed as a waterproof connector. The present invention provides this benefit.

OBJECT AND SUMMARY OF THE INVENTION

It is an object of the invention to provide an electrical connector with a locking mechanism that can be employed as a waterproof connector.

Accordingly, an electrical connector with a locking mechanism of the present invention is hereinafter described. The electrical connector of the present invention includes a generally box-shaped connector housing and a lever. The lever is pivotally connected to the connector housing and is operative to move from a first fixed position to a second fixed position. In the first fixed position, the lever is releasably connected to the connector housing to prevent the lever from moving towards the second fixed position. In the second fixed position, the lever is releasably connected to the connector housing to prevent the lever from moving towards the first fixed position. Upon releasing the lever from the first fixed position, the lever is operative to pivotally move from the first fixed position to the second fixed position.

The electrical connector of the present invention is adapted for matable connection with a workpiece connector having a pair of oppositely-disposed workpiece connector side walls with each workpiece connector side wall having a longitudinally-extending guide rail and a boss projecting laterally therefrom. Initially, as the lever is in a boss-receiving position, a locking mechanism is in a normally relaxed state and a pair of latch mechanisms is in a latched state. The workpiece connector is inserted into a connector cavity of the electrical connector of the present invention while respective ones of a pair of connector channels of the electrical connector of the present invention slidably receive the respective ones of the pair of guide rails of the workpiece connector. The respective ones of the guide rails subsequently contact a respective pair of latch projections of a pair of latch mechanisms of the electrical connector of the present invention causing the respective latch mechanisms to move from the latched state to a release state. Respective ones of the bosses are at least partially received in respective recesses of the lever as the workpiece connector is being inserted into the connector cavity of the electrical connector of the present invention. Thereafter, a force is applied to the lever in the boss-receiving position causing the lever to pivotally move to a boss-capture position thereby capturing the respective bosses within the respective recesses and to continue to pivotally move until the pair of locking mechanisms in the normally relaxed state move to a flexed state and then return to the normally relaxed state thereby locking the lever in a final boss-capture position to prevent the lever from pivotally moving back towards the boss-receiving position.

This object of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 1:
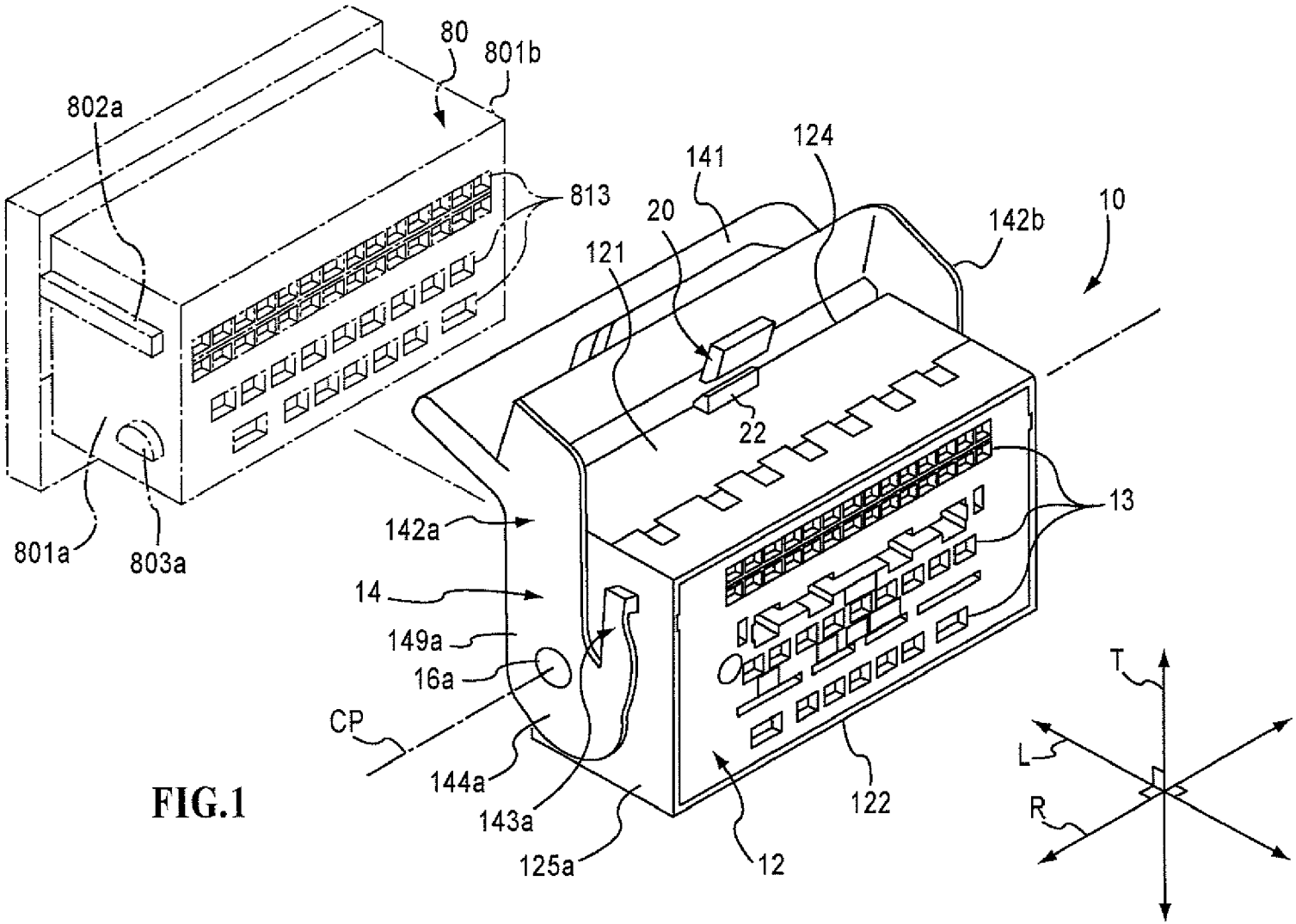
FIG. 1 is a perspective view of a first exemplary embodiment of an electrical connector of the present invention illustrated with a matable workpiece connector.
Figure 2:
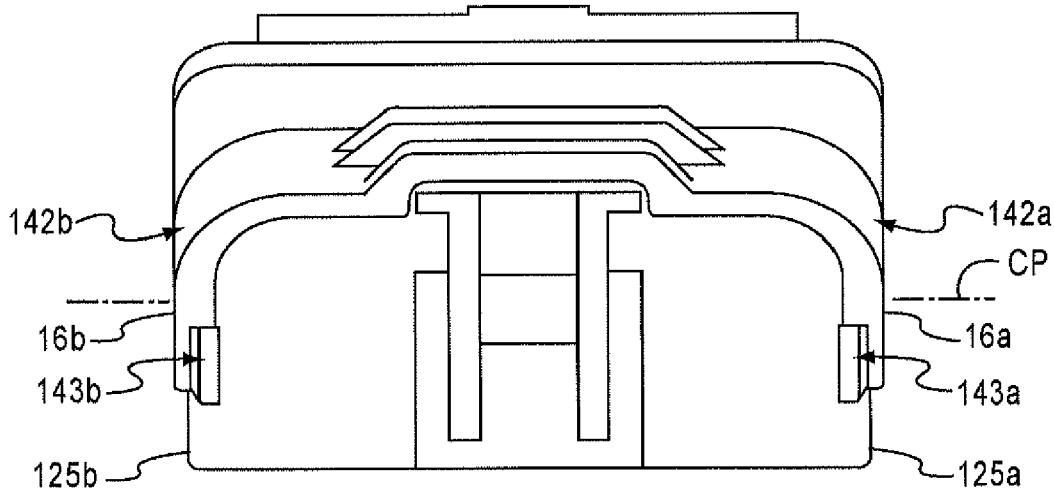
FIG. 2 is a top plan view of the electrical connector of the present invention.
Figure 4:
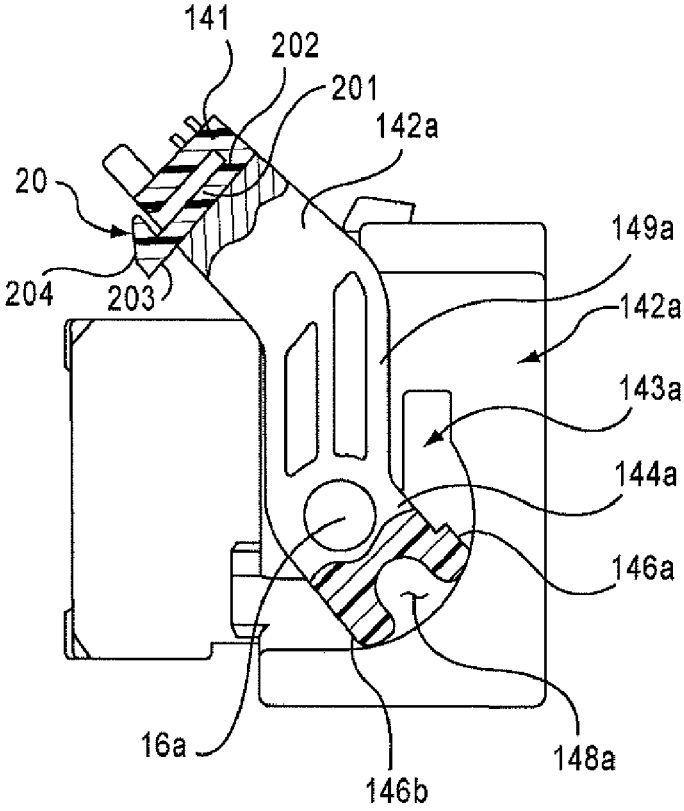
FIG. 4 is a side elevation view partially in cross-section of the electrical connector of the present invention with a lever being in a first fixed position also referred to as a boss-receiving position.
Figure 5:
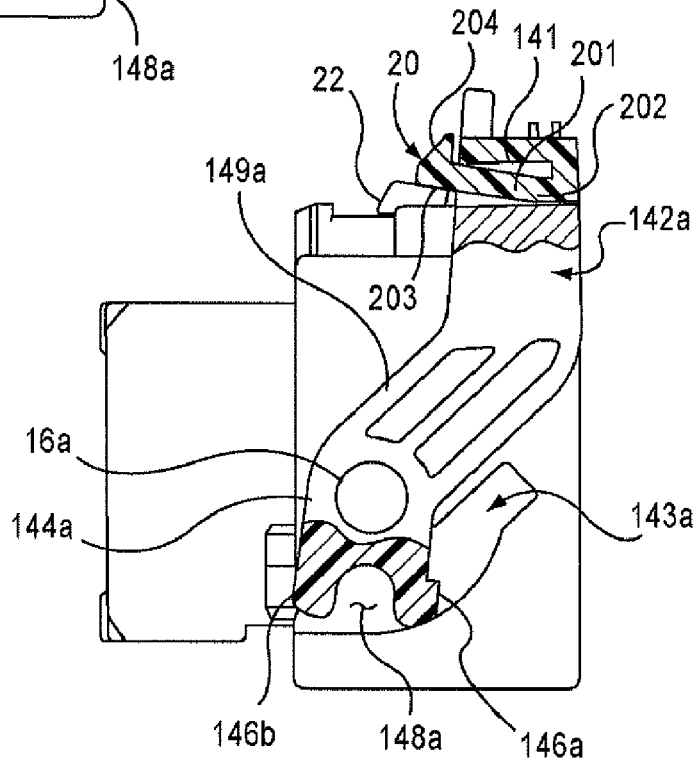
FIG. 5 is a side elevation view partially in cross-section of the electrical connector of the present invention with the lever being in a boss-capture position.
Figure 6:
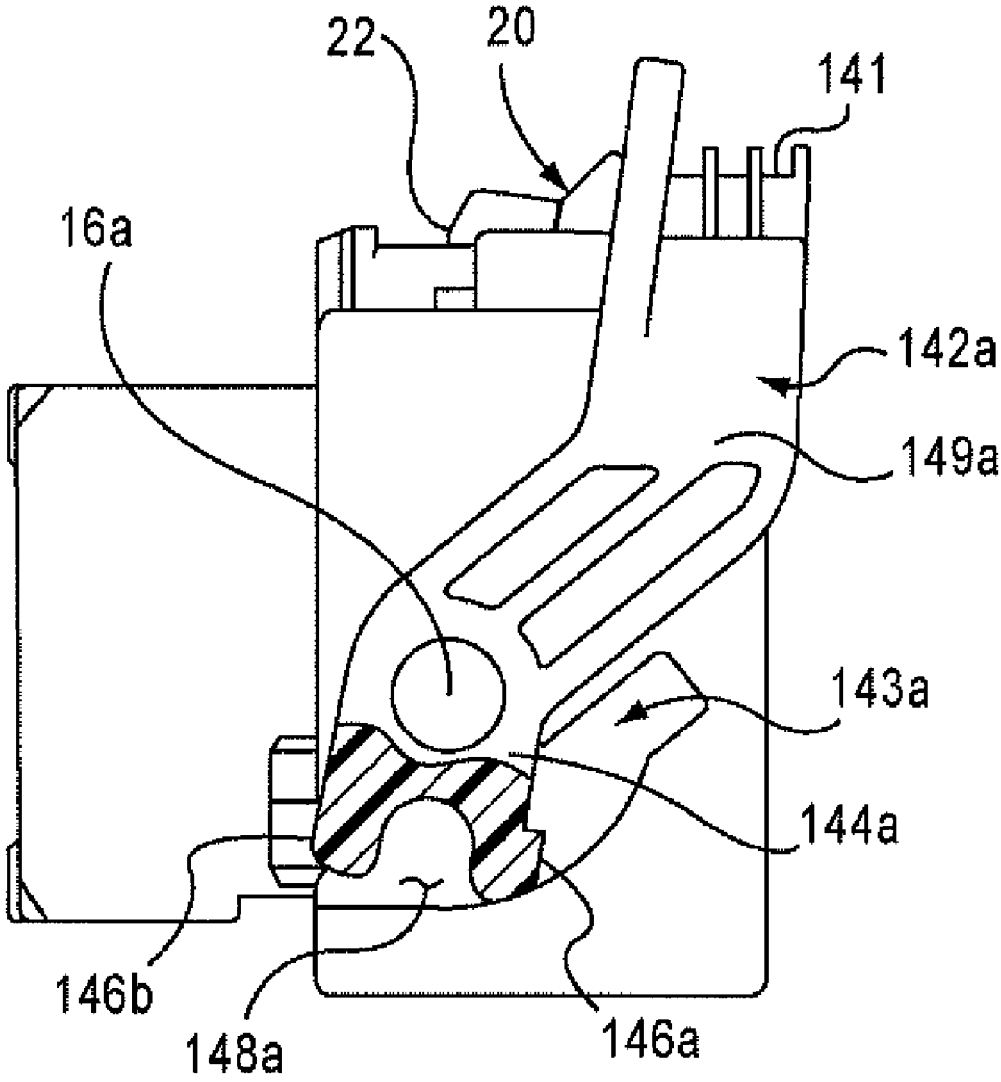
FIG. 6 is a side elevation view of the electrical connector of the present invention with the lever being in a second fixed position also referred to as a boss-capture position.

An exemplary embodiment of an electrical connector 10 of the present invention is hereinafter described with reference to FIGS. 1-10. As best shown in FIGS. 1, 2 and 5, the electrical connector 10 includes a generally box-shaped connector housing 12 and a lever 14. The connector housing 12 has a box-extends along and about a longitudinal axis L, a lateral axis R and a transverse axis T with the longitudinal axis L, the lateral axis R and the transverse axis T being perpendicularly intersecting one another to form a conventional Cartesian coordinate system as illustrated in FIG. 1. The connector housing 12 includes longitudinally-extending terminal-receiving holes 13 as is well known in the art. The lever 14 is pivotally connected to the connector housing and is operative to move from a first fixed position (FIGS. 1 and 4) to a second fixed position (FIG. 6). In the first fixed position (FIGS. 1 and 4), the lever 14 is releasably connected to the connector housing 12 to prevent the lever 14 from moving towards the second fixed position (FIG. 6). In the second fixed position (FIG. 6), the lever 14 is releasably connected to the connector housing 12 to prevent the lever 14 from moving towards the first fixed position (FIGS. 1 and 4). Upon releasing the lever 14 from the first fixed position (FIGS. 1 and 4), the lever 14 is operative to pivotally move from the first fixed position (FIGS. 1 and 4) to the second fixed position (FIG. 6).

One of ordinary skill in the art would appreciate that upon releasing the lever 14 from the second fixed position (FIG. 6), the lever 14 is also operative to pivotally move from the second fixed position (FIG. 6) to the first fixed position (FIGS. 1 and 4). In other words, the lever 14 is operative to pivotally move to and between the first fixed position (FIGS. 1 and 4) and the second fixed position (FIG. 6), if desired.

The electrical connector 10 of the present invention includes various components that are a "pair" of components. For ease of description, reference to each "pair" will be described by the first paired component as reference number suffix "a" while the remaining paired component will be described with the reference number suffix "b".

Figure 3:
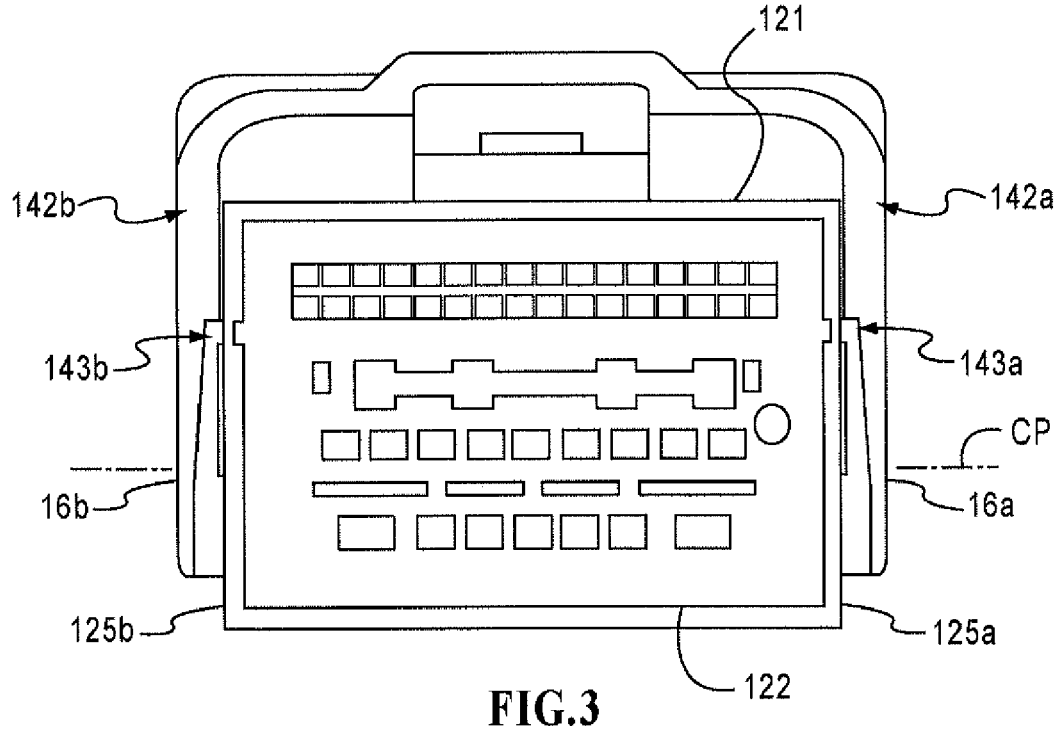
FIG. 3 is a front elevation view of the electrical connector of the present invention.

As shown in FIGS. 2 and 3, the electrical connector 10 also includes a pair of pivot pins 16*a* and 16*b*. The pair of pivot pins 16*a* and 16*b* are disposed apart from one another and are fixedly connected to the connector housing 12 along a common pivot axis CP that extends parallel to the lateral axis R in FIG. 1. The lever 14 includes a cross-member 141, a pair of arm members 142*a* and 142*b* that are connected to the cross-member 141 to form an inverted, generally U-shaped lever 14 as best shown in FIGS. 1 and 2. Respective ones of the pair of arm members 142*a* and 142*b* are pivotally supported by the respective ones of the pair of pivot pins 16*a* and 16*b*.

In FIG. 1, the connector housing 12 includes a top connector housing wall 121, a bottom connector housing wall 122 disposed apart from and extending parallel to the top connector housing wall 121, a front connector housing wall 123 and a rear connector housing wall 124 disposed apart from and extending parallel to one another and interconnecting the top and bottom connector housing walls 121 and 122 respectively. Also, a pair of opposing connector housing side walls 125*a* and 125*b* are disposed apart from and extend parallel to one another. As shown in FIGS. 1-3, the pair of opposing connector housing side walls 125*a* and 125*b* interconnect the top connector housing wall 121, the bottom connector housing wall 122, the front connector housing wall 123 and the rear connector housing wall 124 which defines the generally box-shaped configuration of the electrical connector housing 12.

In FIGS. 1-6, the lever 14 includes the pair of arm members 142*a* and 142*b* mentioned above and a pair of latch mechanisms 143*a* and 143*b*. As best shown in FIGS. 4-6, each arm member 142*a* and 142*b* has a distal-end forked portion 144*a* and 144*b* with a pair of prong elements 146*a* and 146*b*. Each pair of the prong elements 146*a* and 146*b* defines a recess 148*a* and 148*b* therebetween. Also, each arm member 142*a* and 142*b* includes an arm piece 149*a* and 149*b*. Respective ones of the arm pieces 149*a* and 149*b* interconnect the respective ones of the distal-end forked portions 144*a* and 144*b* with the cross-member 141. Respective ones of the pair of latch mechanisms 143*a* and 143*b* are connected respective ones of the pair of arm members 142*a* and 142*b*. For the first exemplary embodiment of the electrical connector 10 and by way of example only, respective ones of the pair of latch mechanisms 143*a* and 143*b* are connected to respective ones of the distal-end forked portions 144*a* and 144*b* and is disposed apart from the respective ones of the arm pieces 149*a* and 149*b*.

Further, respective ones of the pair of pivot pins 16*a* and 16*b* are disposed adjacent to the respective ones of the distal-end forked portions 144*a* and 144*b* and are, effectively, are disposed centrally between respective interfaces of the distal-end forked portions 144*a* and 144*b* and the arm pieces 149*a* and 149*b*.

Figure 7:
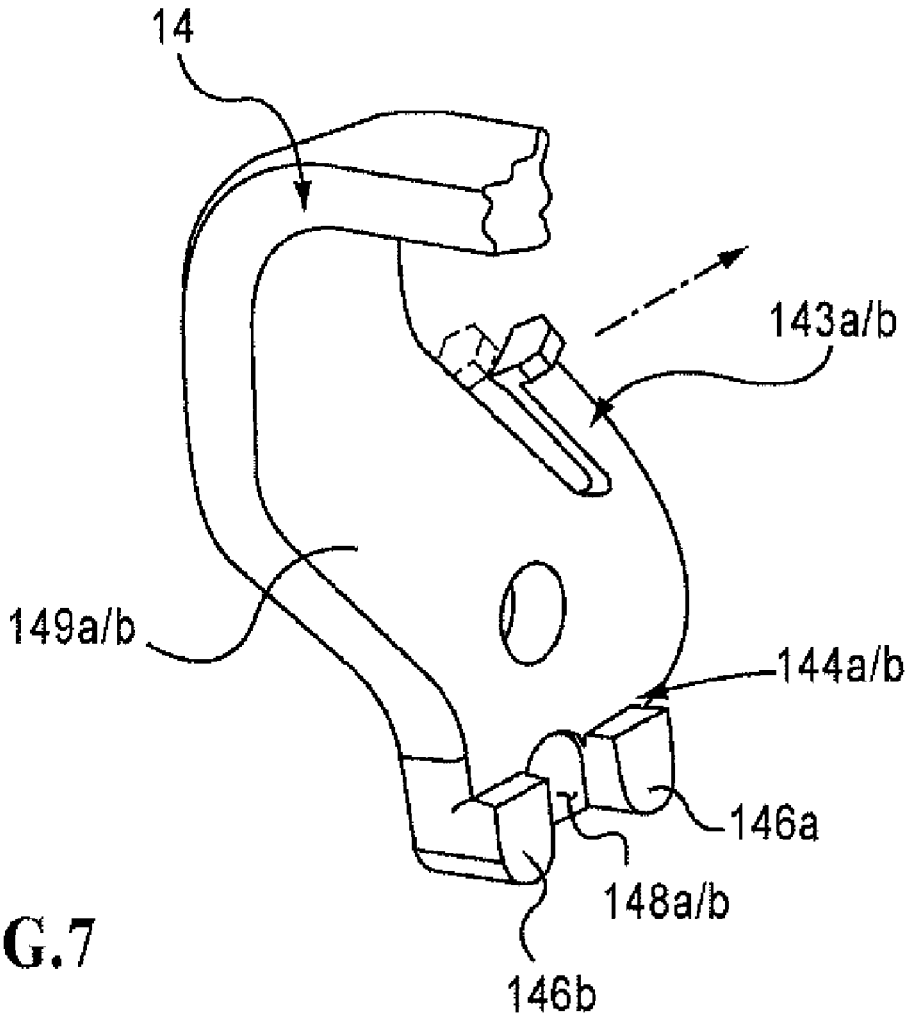
FIG. 7 is a partial perspective view of the lever of the electrical connector of the present invention.
Figure 8:
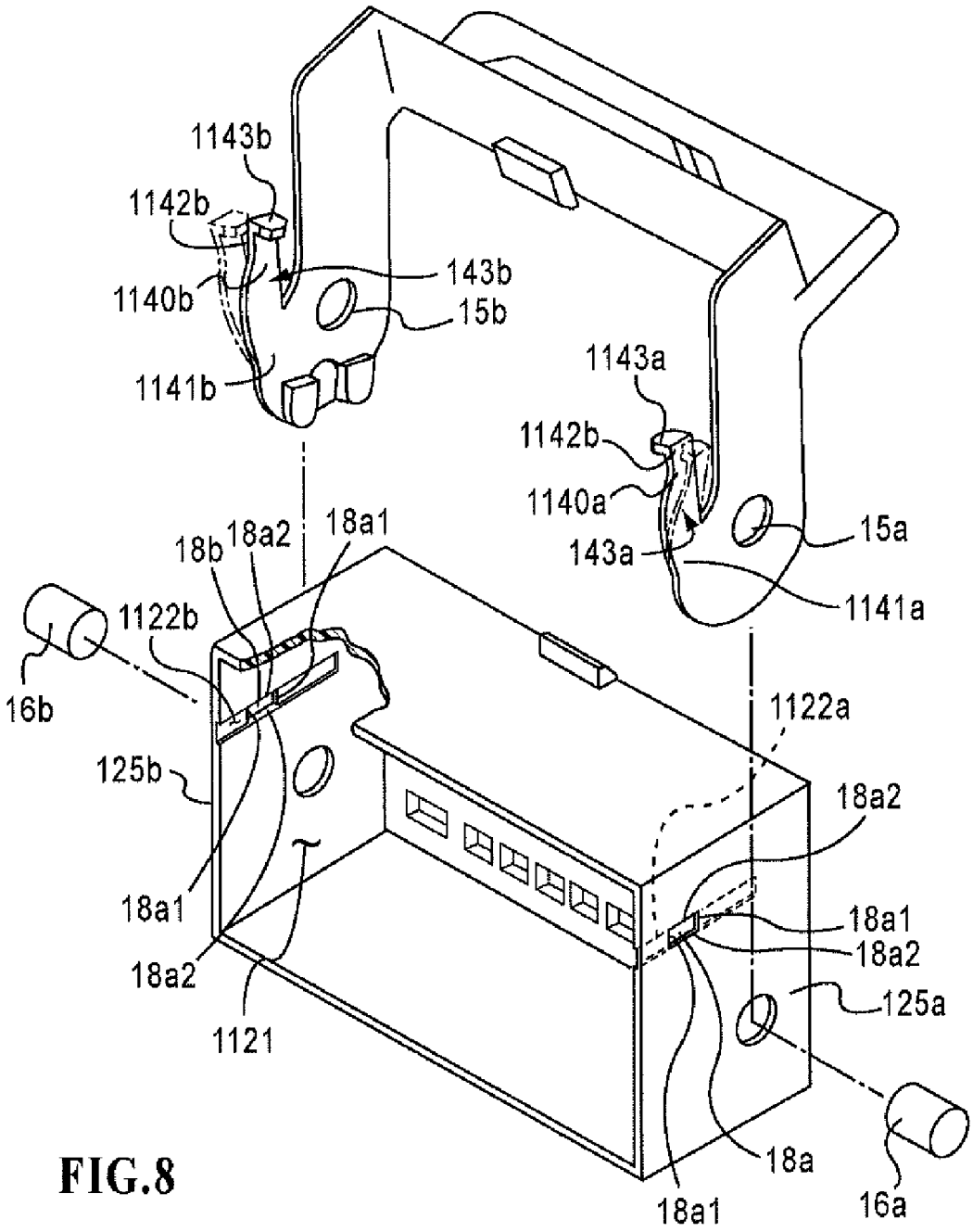
FIG. 8 is a perspective view partially broken away of the electrical connector illustrating a pair of latch holes and a pair of connector housing channels in communication with respective ones of the pair of latch holes.
Figure 9:
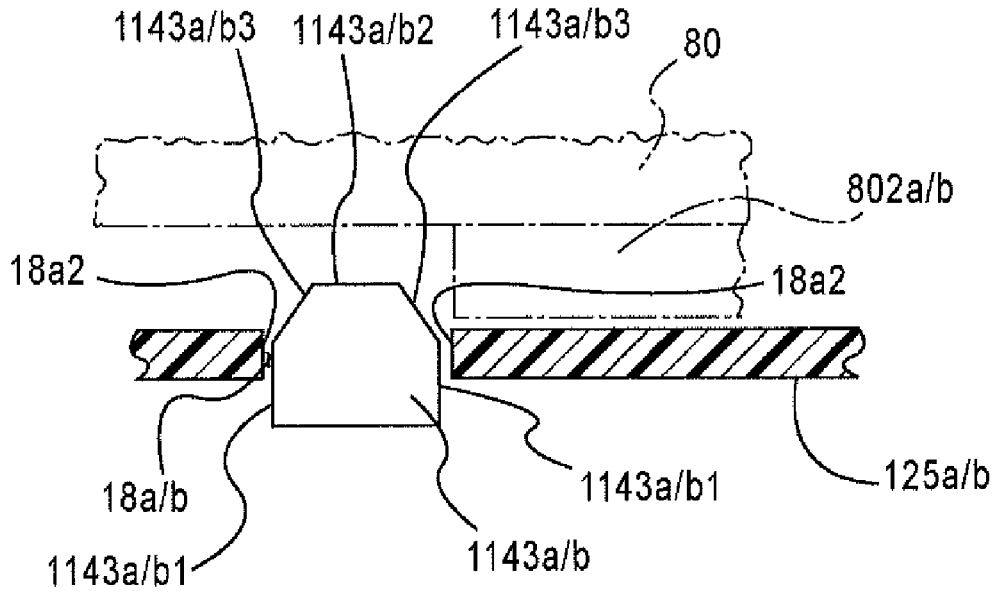
FIG. 9 is an enlarged top plan view partially in cross-section with a latch projection of a latch mechanism shown in a latched state as taken along line 9-9 in FIG. 11.
Figure 10:
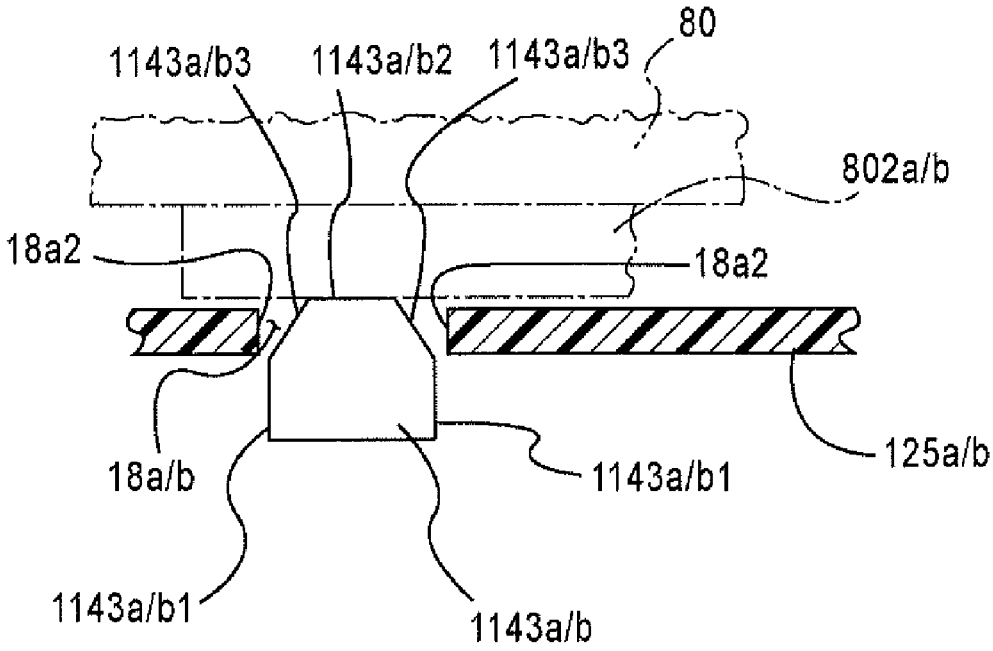
FIG. 10 is an enlarged top plan view partially in cross-section with the latch projection of the latch mechanism shown in a release state as taken along line 10-10 in FIG. 12A.
Figure 11:
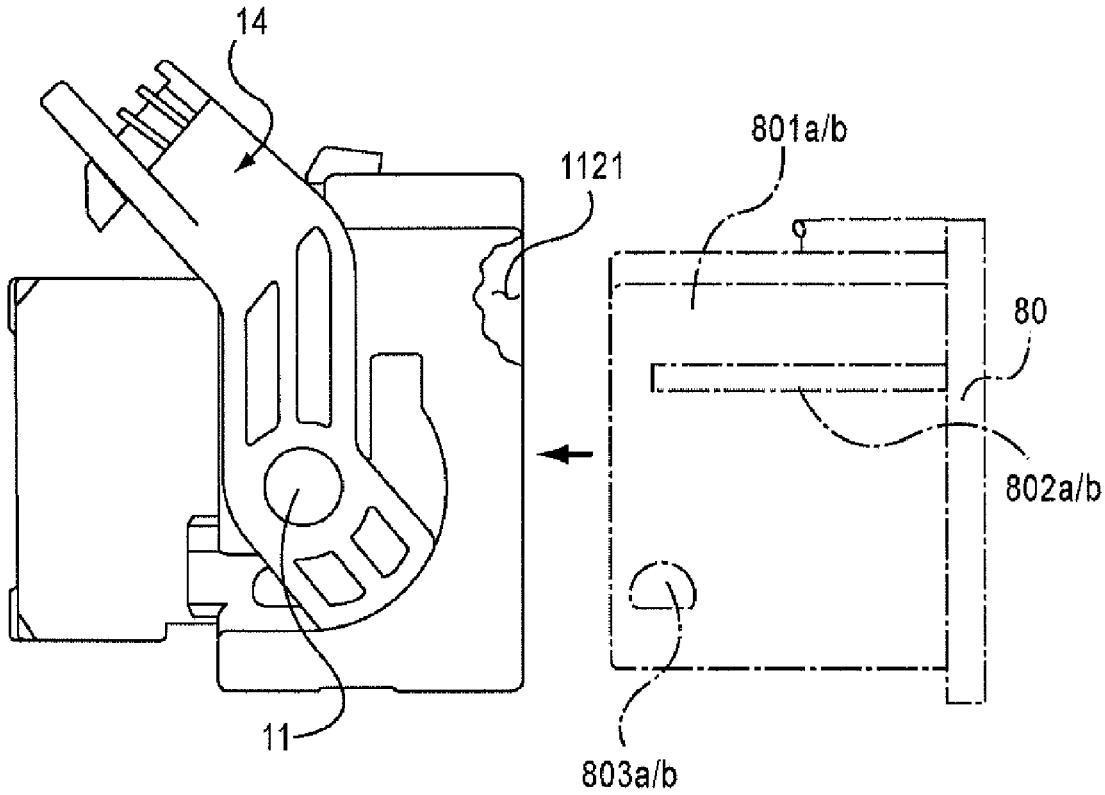
FIG. 11 is a side elevation view of the electrical connector of the present invention positioned to receive a phantomly-drawn workpiece connector with the lever in a boss-receiving position.
Figure 12A:
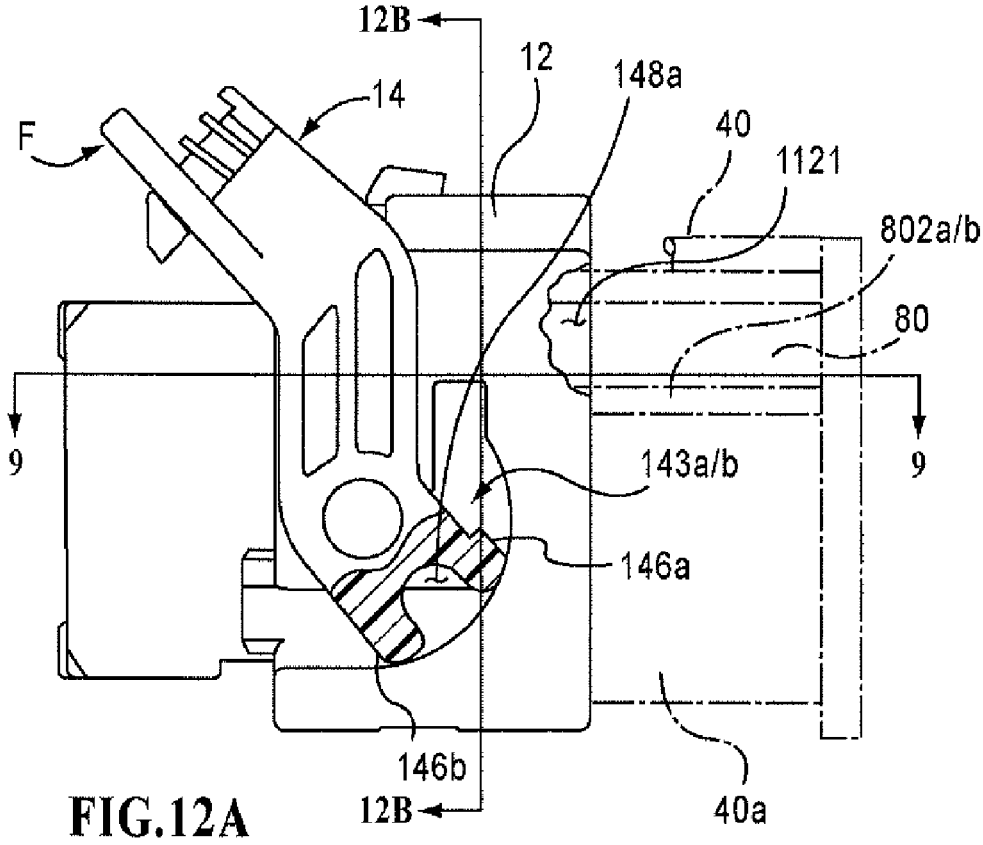
FIG. 12A is a side elevation view of the electrical connector of the present invention receiving the phantomly-drawn workpiece connector with the lever in the boss-receiving position.
Figure 12B:
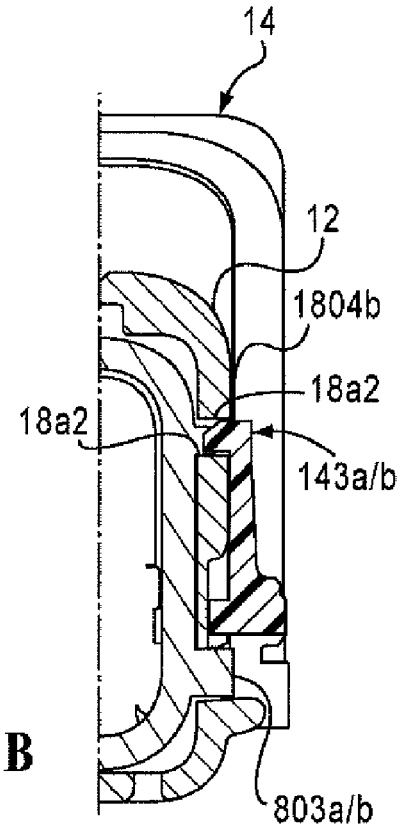
FIG. 12B is a front elevation view of the electrical connector of the present invention taken in cross-section along line 12B-12B in FIG. 12A with the lever in a boss-capture position.
Figure 12C:
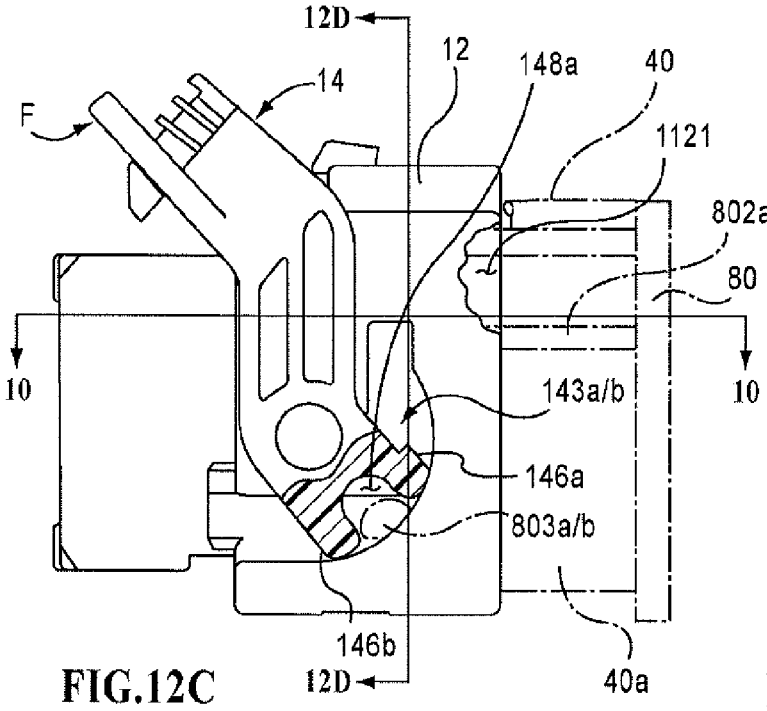
FIG. 12C is a side elevation view partially in cross-section of the electrical connector of the present invention receiving the phantomly-drawn workpiece connector with a phantomly-drawn boss being received by the lever in the boss-capture position.
Figure 12D:
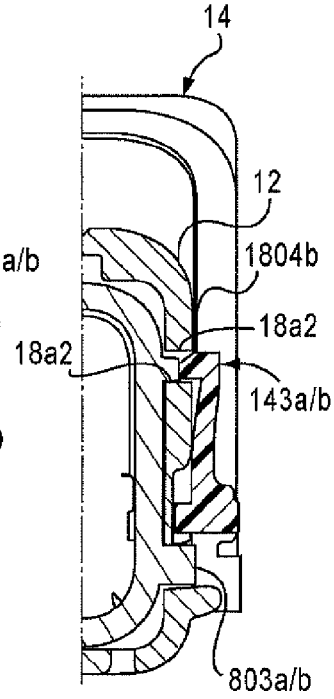
FIG. 12 D is a partial side elevation view in cross-section taken along line 12D-12D in FIG. 12C.

As best shown in FIG. 8, the connector housing 12 includes pair of latch holes 18*a* and 18*b*. Respective ones of the pair of latch holes 18*a* and 18*b* are formed through respective ones of the pair of connector housing side walls 125*a* and 125*b*. Each one of the pair of latch mechanisms 143*a* and 143*b* includes a latch bar 1140*a* or 1140*b*. Each latch bar 1140*a* and 1140*b* has a first latch bar end 1141*a* or 1141*b* and a second latch bar free end 1142*a* or 1142*b* that is disposed opposite the first latch bar end 1141*a* or 1141*b*. The second latch bar free end 1142*a* and 1142*b* has a latch projection 1143*a* or 1142*b* that extends therefrom and is sized to be received by a respective one of the latch holes 18*a* and 18*b* as best reflected in FIG. 8. Respective ones of the latch bars 1140*a* and 1140*b* are connected to respective ones of the arm members 142*a* and 142*b* at the first latch bar end 1141*a* and 1141*b*. Each one of the pair of the latch mechanisms 143*a* and 143*b* is movable to and between a latched state as shown in FIGS. 1, 4, 9 and 11 (FIGS. 9 and 11 are discussed in more detail below) and a release state as shown in FIGS. 10 and 12A (FIGS. 10 and 12A are discussed in more detail below). In the latched state, a respective one of the latch projections 1143*a* and 1143*b* is received by a respective one of the pair of latch holes 18*a* and 18*b* thereby rendering the lever in the first fixed position (FIGS. 1 and 4). In the release state (FIG. 10), respective ones of the latch projections 1143*a* and 1143*b* are at least partially withdrawn from the respective latch holes 18*a* and 18*b*. Further, each one of the pair of latch mechanisms 143*a* and 143*b*, as best shown in FIGS. 7 and 8, is resiliently biased towards the latched state (FIG. 9).

As best shown in FIGS. 9 and 10, each one of the latch projections 1143*a* and 1142*b* has a pair of opposing latch projection side walls 1143*a/b*1 extending parallel to one another, a forward latch projection wall 1143*a/b*2 that extends perpendicularly to the pair of opposing latch projection side walls 1143*a/b*1 and a pair of latch projection ramping walls 1143*a/b*3. Respective ones of the latch projection ramping walls 1143*a/b*1 obliquely interconnect the forward latch projection wall 1143*a/b*2 and respective ones of the pair of opposing latch projection side walls 1143*a/b*1. In the release state (FIG. 10), respective ones of the pair of opposing latch projection side walls 1143*a*1 and 1143*b*1 are withdrawn from the respective ones of the latch holes 18*a* and 18*b* and the pair of latch projection ramping walls 1143*a*3 and 1143*b*3 of each respective one of the latch projections 1143*a* and 1143*b* remains at least partially disposed in respective ones of the latch holes 18*a* and 18*b*. Each one of the pair of the latch holes 18*a* and 18*b* is defined by a first pair of opposing flat latch hole side walls 18*a*1 and a second pair of opposing flat latch hole side walls 18*a*2 that are interconnected to the first pair of opposing flat latch hole side walls 18*a*1 thereby forming a rectangular configuration (See FIG. 8).

In the latched state, respective ones the pair of opposing latch projection side walls 1143*a*1 and 1143*b*1 and respective ones of the first pair of opposing flat latch hole side walls 18*a*2 are facially opposed to each other as shown in FIG. 9. Thus, in the latched state, the lever 14 is immovable in the first fixed position because, as one of ordinary skill in the art would comprehend, the flat latch projection side walls 1143*a/b*1 and the flat latch hole side walls 18*a*2 facially oppose each other. As suggested above, the lever 14 remains in the first fixed position but respective ones of the pair of opposing latch projection side walls 1143*a*1 and 1143*b*1 are withdrawn from the respective ones of the latch holes 18*a* and 18*b* and the pair of latch projection ramping walls 1143*a*3 and 1143*b*3 of each respective one of the latch projections 1143*a* and 1143*b* remains at least partially disposed in respective ones of the latch holes 18*a* and 18*b* while the latch mechanisms 143*a* and 143*b* are in a release state. By applying a force F shown in FIG. 12A to the lever 14 in the first fixed position while the respective latch mechanisms 143*a* and 143*b* are in the release state, the respective latch projection ramping walls 1143*a/b*3 slide along respective edges of the pair of connector housing side walls 125*a* and 125*b* as would be understood by a skilled artisan and representatively drawn in phantom in FIG. 10.

With reference to FIGS. 1, 4 and 5, the electrical connector 10 also includes a locking mechanism 20 that is operably connected to the cross-member 141 and a stop element 22 that is connected to and projects upwardly from the top connector housing wall 121 (See FIG. 1). The locking mechanism 20 includes a locking bar 201. The locking bar 201 has a first locking bar end 202 that is connected to the cross-member 141 to form a cantilevered arrangement and a free locking bar end 203 that is disposed oppositely of the first locking bar end 202. The locking mechanism also has a detent 204 that projects from the free locking bar end 203. The locking mechanism 20 is movable to and between a normally relaxed state (FIG. 4) and a flexed state (phantomly drawing in FIG. 4 and FIG. 5). Note that the locking mechanism 20 is resiliently biased towards the normally relaxed state as illustrated in FIG. 4. As best shown in FIG. 6, the lever 14 is in the second fixed position. In the second fixed position, the detent 204 and the stop element 22 abut one another in a facially opposing manner. Thus, the lever 14 is prevented from moving from the second fixed position (FIG. 6) towards the first fixed position (FIG. 4).

The electrical connector 10 is adapted for matable connection with a workpiece connector 80, shown in FIG. 1. Similar to the electrical connector 10, the workpiece connector 80 has a box-shaped configuration that extends along and about the longitudinal axis L, the lateral axis R and a transverse axis T. The workpiece connector 80 includes longitudinally-extending workpiece terminal-receiving holes 813. The workpiece connector 80 including a pair of oppositely-disposed workpiece connector side walls 801*a* and 801*b*. Each workpiece connector side wall 801*a* and 801*b* has a longitudinally-extending guide rail 802*a* and 802*b* and a boss 803*a* and 803*b* projecting laterally therefrom.

As shown in FIG. 8, the connector housing 12 has a connector cavity 1121 that is sized to slidably receive the workpiece connector 80. Each one of the connector housing side walls 125*a* and 125*b* is formed with a connector housing channel 1122 disposed inside the connector cavity 1121 and is sized to slidably receive the respective guide rails 802*a* and 802*b*. A respective latch hole 18*a* and 18*b* extends through the each one of the connector housing side walls 125*a* and 125*b* as shown in FIG. 8. Respective ones of the latch holes 18*a* and 18*b* are in communication with respective ones of the connector housing channels 1122*a* and 1122*b*. Respective ones of the pair of pivot pins 16*a* and 16*b* are connected to and extend laterally outwardly from the connector housing side walls 125*a* and 125*b* and are aligned along the common pivot axis CP that extends parallel to the lateral axis L. The lever 14 includes pivot pin receiving holes 15*a* and 15*b* for receiving the respective ones of the pivot pins 16*a* and 16*b*.

The lever 14 is pivotally connected to the connector housing 12 and is operative to move from a boss-receiving position to a boss-capture position. The boss-receiving position is equivalent to the first fixed position (FIGS. 1 and 4) described above and is used to better describe how the electrical connector 10 of the present invention works in conjunction with the workpiece connector 80. Likewise, the boss-capture position is equivalent to the second fixed position (FIG. 6) described above and is used to better describe how the electrical connector 10 of the present invention works in conjunction with the workpiece connector 80. Thus, the boss-receiving position is illustrated in FIGS. 1 and 4 as well as in FIGS. 11 and 12A-12D and the boss-capture position is illustrated in FIGS. 5 and 6 as well as in FIG. 13.

As best shown in FIGS. 12A-12D and 13, respective ones of the pair of prong elements 146*a* and 146*b* with each pair of prong elements 146*a* and 146*b* defining a respective recess 148*a* and 148*b* therebetween. Respective ones of the recesses 148*a* and 148*b* are sized to receive respective ones of the bosses 803*a* and 803*b* such that when the lever 14 is in the boss-receiving position (FIGS. 11 and 12A-12D), the recesses 148*a* and 148*b* are oriented to receive the bosses 803*a* and 803*b*. When the lever 14 is in the boss-capture position (FIGS. 12A-12D and 13, the bosses 803*a* and 803*b* are received in the respective recesses 148*a* and 148*b* between the respective pairs of prong elements 146*a* and 146*b* preventing the bosses 803*a* and 803*b* from being removed therefrom.

Figure 13:
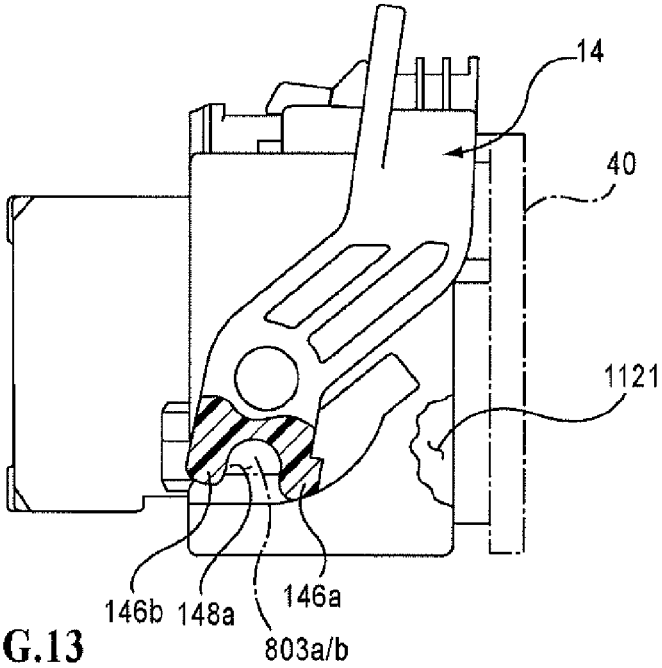
FIG. 13 is a side elevation view of the electrical connector of the present invention that received the phantomly-drawn workpiece connector with the lever in a final boss-capture position and with a locking mechanism in a normally relaxed state yet preventing the lever from moving towards the boss-receiving position.

The operation of the electrical connector 10 and the workpiece connector 80 is described with reference to FIGS. 11-13. Initially, as the lever 14 is in the boss-receiving position (FIGS. 11 and 12A-12D), the of locking mechanism 20 is in the normally relaxed state (FIG. 4) and the pair of latch mechanisms 143*a* and 142*b* are in the latched state (FIGS. 1, 4 and 9). The workpiece connector 40 is inserted into the connector cavity 1121 while respective ones of the pair of connector channels 1122*a* and 1122*b* (best shown in FIG. 8) slidably receive the respective ones of the pair of guide rails 802*a* and 802*b*. As best illustrated in FIGS. 9 and 10, the respective ones of the guide rails 802*a* and 802*b* subsequently contact respective ones of the pair of latch projections causing the respective latch mechanisms 143*a* and 143*b* to move from the latched state (FIG. 9) to the release state (FIG. 10). Meanwhile, the respective ones of the bosses 803*a* and 803*b* are at least partially received in the respective recesses 148*a* and 148*b* as best shown in FIG. 12A. Thereafter, a force F is applied to the lever 14 in the boss-receiving position as shown in FIG. 12A thereby causing the lever 14 to pivotally move to the boss-capture position, for example only, in FIG. 13, thereby capturing the respective bosses 803*a* and 803*b* within the respective recesses 148*a* and 148*b* between the respective pairs of prong elements 146*a* and 146*b* and to continue to pivotally move (from FIG. 12A to FIG. 13) until the locking mechanism 20 in the normally relaxed state (FIG. 4) moves to the flexed state (FIG. 5) and then returns to the normally relaxed state (FIG. 6) thereby locking the lever 14 in a final boss-capture position (FIGS. 6 and 13) to prevent the lever 14 from pivotally moving back towards the boss-receiving position (FIGS. 11 and 12A).

Figure 14A:
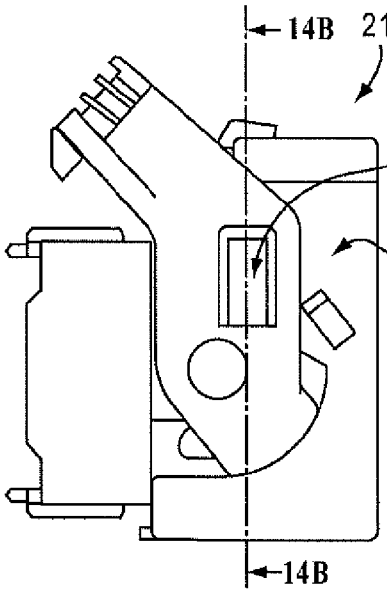
FIG. 14A is a side elevantion view of a second exemplary embodiment of an electrical connector of the present invention with a first modified latch mechanism.
Figure 14B:
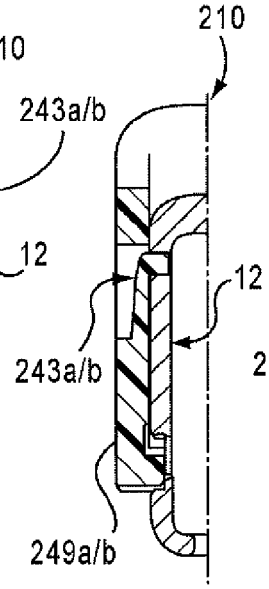
FIG. 14B is a partial side elevation view in cross-section taken along line 14B-14B in FIG. 14A.
Figure 14C:
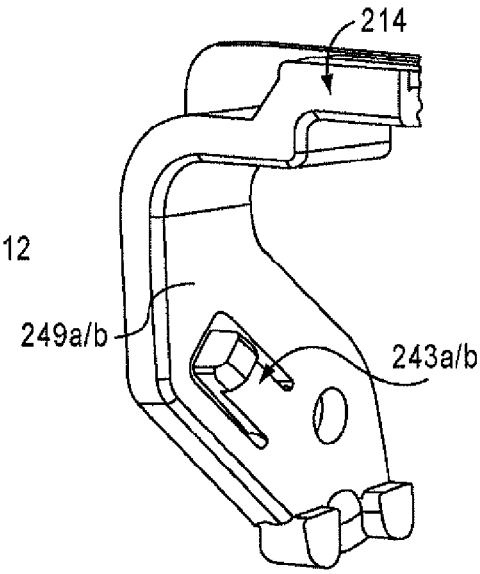
FIG. 14C is a partial perspective view of the lever and the first modified latch mechanism shown in FIGS. 14A and 14B.

A second exemplary embodiment of an electrical connector 210 of the present invention is introduced in FIGS. 14A-14C. The second exemplary embodiment of the electrical connector 210 is similar to the first exemplary embodiment of the electrical connector 10 except of the positioning of the latch mechanisms 243*a* and 243*b*. The latch mechanisms 243*a* and 243*b* are disposed centrally and internally of arm pieces 249*a* and 249*b* of a lever 214.

Figure 15A:
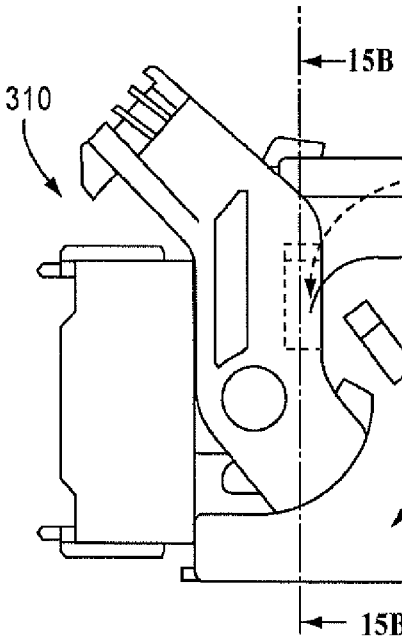
FIG. 15A is a side elevation view of a third exemplary embodiment of an electrical connector of the present invention with a second modified latch mechanism.
Figure 15B:
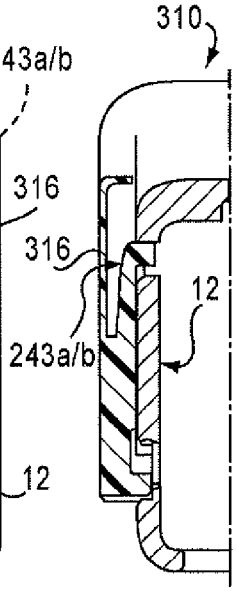
FIG. 15B is a partial side elevation view in cross-section taken along line 15B-15B in FIG. 15A.
Figure 15C:
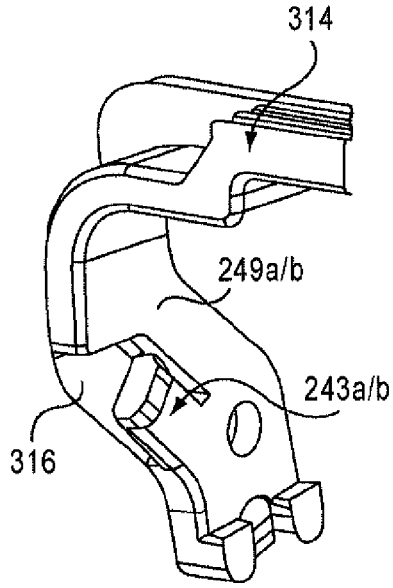
FIG. 15C is a partial perspective view of the lever and the second modified latch mechanism shown in FIGS. 15A and 15B.

A third exemplary embodiment of an electrical connector 310 of the present invention is introduced in FIGS. 15A-15C. The third exemplary embodiment of the electrical connector 310 is similar to the first exemplary embodiment of the electrical connector 10 except of the positioning of the latch mechanisms 243*a* and 243*b*. The latch mechanisms 243*a* and 243*b* are disposed internally of arm pieces 249*a* and 249*b* of a lever 314 along an edge thereof. A cover 316 covers the latch mechanisms 243*a* and 243*b*.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector, comprising:

a generally box-shaped connector housing;

a lever pivotally connected to the connector housing and operative to move from a first fixed position to a second fixed position; and at least one pivot pin interconnecting the connector housing and the lever, wherein, in the first fixed position, the lever is releasably connected to the connector housing to prevent the lever from moving towards the second fixed position, in the second fixed position, the lever is releasably connected to the connector housing to prevent the lever from moving towards the first fixed position, and upon releasing the lever from the first fixed position, the lever is operative to pivotally move from the first fixed position to the second fixed position, wherein the lever includes at least one arm member having a distal-end forked portion with a pair of prong elements defining a recess therebetween and a latch mechanism connected to the at least one arm member, the at least one pivot pin disposed adjacent the distal-end forked portion, wherein the connector housing includes a latch hole formed therethrough and the latch mechanism includes a latch bar having a first latch bar end connected to the at least one arm member and a second latch bar free end disposed opposite the first latch bar end, the second latch bar free end having a latch projection extending therefrom and sized to be received by the latch hole, the latch mechanism movable to and between a latched state and a release state such that, in the latched state, the latch projection is received by the latch hole thereby rendering the lever in the first fixed position and, in the release state, the latch projection is at least partially withdrawn from the latch hole, the latch mechanism being resiliently biased towards the latched state, and wherein the latch projection has a pair of opposing latch projection side walls extending parallel to one another, a forward latch projection wall extending perpendicularly to the pair of opposing latch projection side walls and a pair of latch projection ramping walls, respective ones of the latch projection ramping walls obliquely interconnecting the forward latch projection wall and respective ones of the pair of opposing latch projection side walls.

2. An electrical connector according to claim 1, wherein the lever is operative to pivotally move to and between the first fixed position and the second fixed position.

3. An electrical connector according to claim 2, wherein, upon releasing the lever from the second fixed position, the lever is operative to pivotally move from the second fixed position to the first fixed position.

4. An electrical connector according to claim 1, wherein, in the release state, the pair of opposing latch projection side walls are withdrawn from the latch hole and the pair of ramping walls remain at least partially disposed in the latch hole.

5. An electrical connector according to claim 4, wherein the latch hole is defined by a first pair of opposing flat latch hole side walls and a second pair of opposing flat latch hole side walls interconnected to the first pair of opposing flat latch hole side walls thereby forming a rectangular configuration, and in the latched state, respective ones the pair of opposing latch projection side walls and respective ones of the first pair of opposing flat latch hole side walls are facially opposed to each other.

6. An electrical connector, comprising:

a generally box-shaped connector housing;

a lever pivotally connected to the connector housing and operative to move from a first fixed position to a second fixed position; and a pair of pivot pins fixedly connected to the connector housing along a common pivot axis and the lever includes a cross-member, a pair of arm members connected to the cross-member to form an inverted, generally U-shaped lever, respective ones of the pair of pivot pins are disposed apart from one another, respective ones of the pair of arm members are pivotally supported by the respective ones of the pair of pivot pins, wherein, in the first fixed position, the lever is releasably connected to the connector housing to prevent the lever from moving towards the second fixed position, in the second fixed position, the lever is releasably connected to the connector housing to prevent the lever from moving towards the first fixed position, and upon releasing the lever from the first fixed position, the lever is operative to pivotally move from the first fixed position to the second fixed position, wherein the connector housing includes a top connector housing wall, a bottom connector housing wall disposed apart from and extending parallel to the top connector housing wall, a front connector housing wall and a rear connector housing wall disposed apart from and extending parallel to one another and interconnecting the top and bottom connector housing walls and a pair of opposing connector housing side walls disposed apart from and extending parallel to one another and interconnecting the top, bottom, front and rear connector housing walls, wherein the lever includes a pair of arm members and a pair of latch mechanisms, each arm member having a distal-end forked portion with a pair of prong elements defining a recess therebetween, a respective one of the pair of latch mechanisms connected to a respective one of the pair of arm members, respective ones of the pair of pivot pins disposed adjacent to respective ones of the distal-end forked portions, wherein the connector housing includes pair of latch holes, respective ones of the pair of latch holes being formed through respective ones of the pair of connector housing side walls and each one of the pair of latch mechanisms includes a latch bar having a first latch bar end and a second latch bar free end disposed opposite the first latch bar end, the second latch bar free end having a latch projection extending therefrom and sized to be received by a respective one of the latch holes, respective ones of the latch bars connected to respective ones of the arm members at the first latch bar end, each one of the pair of the latch mechanisms movable to and between a latched state and a release state such that, in the latched state, a respective one of the latch projections is received by a respective one of the pair of latch holes thereby rendering the lever in the first fixed position and, in the release state, respective ones of the latch projections are at least partially withdrawn from the respective latch holes, each one of the pair of latch mechanisms being resiliently biased towards the latched state and wherein each one of the latch projections has a pair of opposing latch projection side walls extending parallel to one another, a forward latch projection wall extending perpendicularly to the pair of opposing latch projection side walls and a pair of latch projection ramping walls, respective ones of the latch projection ramping walls obliquely interconnecting the forward latch projection wall and respective ones of the pair of opposing latch projection side walls.

7. An electrical connector according to claim 6, wherein, in the release state, respective ones of the pair of opposing latch projection side walls are withdrawn from respective ones of the latch holes and the pair of latch projection ramping walls of each respective one of the latch projections remains at least partially disposed in respective ones of the latch holes.

8. An electrical connector according to claim 7, wherein each one of the pair of the latch holes is defined by a first pair of opposing flat latch hole side walls and a second pair of opposing flat latch hole side walls interconnected to the first pair of opposing flat latch hole side walls thereby forming a rectangular configuration, and in the latched state, respective ones the pair of opposing latch projection side walls and respective ones of the first pair of opposing flat latch hole side walls are facially opposed to each other.

9. An electrical connector according to claim 6, further comprising a locking mechanism operably connected to the cross-member and a stop element connected to and projecting upwardly from the top connector housing wall.

10. An electrical connector according to claim 9, wherein the locking mechanism includes a locking bar having a first locking bar end connected to the cross-member to form a cantilevered arrangement and a free locking bar end disposed oppositely of the first locking bar end and having a detent projecting from the free locking bar end, the locking mechanism movable to and between a normally relaxed state and a flexed state, the locking mechanism resiliently biased towards the normally relaxed state.

11. An electrical connector according to claim 10, wherein, in the second fixed position, the detent and the stop element abut one another in a facially opposing manner thereby preventing the lever from moving from the second fixed position towards the first fixed position.

12. An electrical connector adapted for matable connection with a workpiece connector having a box-shaped configuration extending along and about a longitudinal axis, a lateral axis and a transverse axis, the longitudinal axis, the lateral axis and the transverse axis perpendicularly intersecting one another to form a conventional Cartesian coordinate system, the workpiece connector including a pair of oppositely-disposed workpiece connector side walls with each workpiece connector side wall having a longitudinally-extending guide rail and a boss projecting laterally therefrom, the electrical connector comprising:

a generally box-shaped connector housing having a connector cavity sized to slidably receive the workpiece connector, the connector housing including a top connector housing wall, a bottom connector housing wall disposed apart from and extending parallel to the top connector housing wall, a front connector housing wall and a rear connector housing wall disposed apart from and extending parallel to one another and interconnecting the top and bottom connector housing walls and a pair of opposing connector housing side walls disposed apart from and extending parallel to one another and interconnecting the top, bottom, front and rear connector housing walls, each one of the connector housing side walls being formed with a connector housing channel disposed inside the connector cavity and sized to slidably receive the respective guide rails and with a respective latch hole extending through the each one of the connector housing side walls and with respective ones of the latch holes being in communication with respective ones of the connector housing channels;

a pair of pivot pins, respective ones of the pair of pivot pins being disposed apart from one another, connected to and extending laterally outwardly from the connector housing side walls and aligned along a common pivot axis extending parallel to the lateral axis;

a lever pivotally connected to the connector housing and operative to move from a boss-receiving position to a boss-capture position, the lever including a pair of arm members, a cross-member and a pair of latch mechanisms, each arm member having a distal-end forked portion with a pair of prong elements defining a recess therebetween, the cross-member connected to the pair of arm members to form an inverted, generally U-shaped lever, respective ones of the pair of arm members being pivotally supported by the respective ones of the pair of pivot pins, each arm member having a distal-end forked portion with a pair of prong elements defining a recess therebetween sized to receive a respective one of the bosses such that when the lever is in the boss-receiving position, the recesses are oriented to receive the bosses and, when the lever is in the boss-capture position, the bosses are received in the respective recesses between the respective pairs of prong elements preventing the bosses from being removed therefrom, a respective one of the pair of latch mechanisms connected to a respective one of the pair of arm members, respective ones of the pair of pivot pins disposed adjacent to respective ones of the distal-end forked portions, a respective one of latch mechanisms connected to respective ones of the arm members, each latch mechanism including a latch bar having a first latch bar end connected to the respective one of the arm members and a second latch bar free end disposed opposite the first latch bar end, the second latch bar free end having a latch projection extending therefrom and sized to be received by a respective latch hole, each latch mechanism movable to and between a latched state and a release state such that, in the latched state, respective ones of the latch projections being received by the respective ones of the latch holes and, in the release state, respective ones of the latch projections are at least partially withdrawn from the respective ones of the latch holes, each latch mechanism being resiliently biased towards the latched state;

a stop element connected to and projecting upwardly from the top connector housing wall; and a locking mechanism operably connected to the cross-member and including a locking bar having a first locking bar end connected to the top connector housing wall in a cantilevered manner and a free locking bar end disposed oppositely of the first locking bar end and having a detent projecting from the free locking bar end, the locking mechanism movable to and between a normally relaxed state and a flexed state with the locking mechanism resiliently biased towards the normally relaxed state, wherein, initially, as the lever is in the boss-receiving position, the pair of locking mechanisms are in the normally relaxed state and the pair of latch mechanisms are in the latched state, the workpiece connector is inserted into the connector cavity while respective ones of the pair of connector channels slidably receive the respective ones of the pair of guide rails, the respective ones of the guide rails subsequently contact respective ones of the pair of latch projections causing the respective latch mechanisms to move from the latched state to the release state and the respective ones of the bosses are at least partially received in the respective recesses, thereafter, a force is applied to the lever in the boss-receiving position causing the lever to pivotally move to the boss-capture position thereby capturing the respective bosses within the respective recesses between the respective pairs of prong elements and to continue to pivotally move until the locking mechanism in the normally relaxed state moves to the flexed state and then returns to the normally relaxed state thereby locking the lever in a final boss-capture position to prevent the lever from pivotally moving back towards the boss-receiving position.

* * * * *